US011959650B2

(12) United States Patent
Mori et al.

(10) Patent No.: US 11,959,650 B2
(45) Date of Patent: Apr. 16, 2024

(54) OUTDOOR UNIT OF AIR-CONDITIONING APPARATUS

(71) Applicant: Mitsubishi Electric Corporation, Tokyo (JP)

(72) Inventors: Tomohiro Mori, Tokyo (JP); Keizo Kamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 532 days.

(21) Appl. No.: 17/279,896

(22) PCT Filed: Nov. 16, 2018

(86) PCT No.: PCT/JP2018/042416

§ 371 (c)(1),
(2) Date: Mar. 25, 2021

(87) PCT Pub. No.: WO2020/100273

PCT Pub. Date: May 22, 2020

(65) Prior Publication Data

US 2022/0034524 A1 Feb. 3, 2022

(51) Int. Cl.
*F24F 11/86* (2018.01)
*F24F 1/24* (2011.01)
(Continued)

(52) U.S. Cl.
CPC ..... *F24F 1/24* (2013.01); *F24F 1/46* (2013.01); *F24F 11/0001* (2013.01); *F24F 11/79* (2018.01); *F24F 2110/10* (2018.01)

(58) Field of Classification Search
CPC . F24F 11/86; F24F 11/89; F25B 49/00; F25B 49/02; F25B 49/022; F25B 2600/02;
(Continued)

(56) References Cited

U.S. PATENT DOCUMENTS 3,689,203 A * 9/1972 Vaughn ..... F25B 31/02 417/363
4,266,406 A 5/1981 Ellis
(Continued)

FOREIGN PATENT DOCUMENTS

EP 1684023 A1 7/2006
JP 2006-317099 A 11/2006
(Continued)

OTHER PUBLICATIONS

Office Action dated Oct. 5, 2021, issued in corresponding JP Patent Application No. 2020-556546 (and English Machine Translation).
(Continued)

*Primary Examiner* — Frantz F Jules
*Assistant Examiner* — Jason N Thompson
(74) *Attorney, Agent, or Firm* — POSZ LAW GROUP, PLC

(57) ABSTRACT

An outdoor unit of an air-conditioning apparatus includes a compressor, a heat exchanger, and a controller. The controller includes a compressor driving circuit configured to drive the compressor, a harmonic suppressing unit configured to suppress harmonics in the compressor driving circuit, and a housing containing the compressor driving circuit and the harmonic suppressing unit. The housing has a first section having ventilation holes that allow communication between the outside and the inside, and a second section constituting a frame outside the first section. The first section contains the harmonic suppressing unit and a fan configured to blow air from inside the first section to the outside through the ventilation holes. The second section contains the compressor driving circuit.

10 Claims, 10 Drawing Sheets

(51) Int. Cl.

| | |
|---|---|
| ***F24F 1/46*** | (2011.01) |
| ***F24F 11/00*** | (2018.01) |
| ***F24F 11/79*** | (2018.01) |
| ***F24F 11/89*** | (2018.01) |
| ***F25B 31/00*** | (2006.01) |
| ***F25B 31/02*** | (2006.01) |
| ***F25B 49/02*** | (2006.01) |
| *F24F 110/10* | (2018.01) |

(58) Field of Classification Search
CPC ..... F25B 2500/13; F25B 2400/071; F25B 2400/077; F25B 31/02; F25B 31/006; F25B 49/025
See application file for complete search history.

(56) References Cited

U.S. PATENT DOCUMENTS 5,764,011 A * 6/1998 Nakae ..... F24F 11/52 318/434
10,594,239 B2 * 3/2020 Li ..... H02P 21/05
2015/0214863 A1 * 7/2015 Sumi ..... H02M 7/53875 318/454
2016/0087547 A1 * 3/2016 Yamada ..... H02M 1/4225 363/124
2016/0201973 A1 * 7/2016 Lokhande ..... F25D 23/006 248/678
2017/0124716 A1 5/2017 Wang
2017/0214354 A1 * 7/2017 Yamakawa ..... H02M 5/458
2018/0187905 A1 * 7/2018 Doi ..... H05K 1/0203
2021/0055007 A1 * 2/2021 Yaji ..... F24F 11/88
2021/0305879 A1 * 9/2021 Nishimori ..... B32B 3/266

FOREIGN PATENT DOCUMENTS

JP 2017-090447 A 5/2017
JP 2017-101886 A 6/2017
WO 2013/001829 A1 1/2013

OTHER PUBLICATIONS

Extended European Search Report dated Oct. 22, 2021, issued in corresponding European Patent Application No. 18940237.3.
International Search Report dated Dec. 11, 2018, issued in corresponding International Application No. PCT/JP2018/042416.

* cited by examiner

OUTDOOR UNIT OF AIR-CONDITIONING APPARATUS

CROSS REFERENCE TO RELATED APPLICATION

This application is a U.S. National Stage Application of International Application No. PCT/JP2018/042416, filed on Nov. 16, 2018 the contents of which are incorporated herein by reference.

TECHNICAL FIELD

The present invention relates to an outdoor unit of an air-conditioning apparatus, including a harmonic suppressing unit.

BACKGROUND ART

Conventionally, an outdoor unit of an air-conditioning apparatus has been known to have a configuration in which, as disclosed for example in Patent Literature 1, a chassis forming a framework contains therein a compressor, an air-sending device, and a controller that controls the compressor and the air-sending device. The controller has a configuration in which a control board with electric and electronic components mounted thereon is housed inside a housing.

CITATION LIST

Patent Literature

Patent Literature 1: Japanese Unexamined Patent Application Publication No. 2006-317099

SUMMARY OF INVENTION

Technical Problem

In the outdoor unit of the air-conditioning apparatus, the controller is known to include a harmonic suppressing unit, such as a reactor, to reduce power supply noise. The harmonic suppressing unit and other electric and electronic components are arranged together in the same section of the chassis. In the outdoor unit of the air-conditioning apparatus, therefore, overheating of the harmonic suppressing unit degrades the performance of the electric and electronic components and shortens their product life.

The present invention has been made to solve the problems described above. An object of the present invention is to provide an outdoor unit of an air-conditioning apparatus in which, even if the harmonic suppressing unit is overheated, the performance and product life of the electric and electronic components are less likely to be affected.

Solution to Problem

An outdoor unit of an air-conditioning apparatus according to an embodiment of the present invention includes a compressor, a heat exchanger, and a controller. The controller includes a compressor driving circuit configured to drive the compressor, a harmonic suppressing unit configured to suppress harmonics in the compressor driving circuit, and a housing containing the compressor driving circuit and the harmonic suppressing unit. The housing has a first section having ventilation holes that allow communication between the outside and the inside, and a second section constituting a frame outside the first section. The first section contains the harmonic suppressing unit and a fan that blows air from inside the first section to the outside through the ventilation holes. The second section contains the compressor driving circuit.

Advantageous Effects of Invention

According to the embodiment of the present invention, the housing containing electric and electronic components has the first section and the second section. The electric and electronic components, such as the compressor driving circuit, whose performance and product life are significantly affected by temperature rise, are disposed in the second section. Since this enables isolation from the harmonic suppressing unit disposed in the first section, it is less likely that the performance and product life of the electric and electronic components of the controller will be affected.

DESCRIPTION OF EMBODIMENTS

Figure 1:
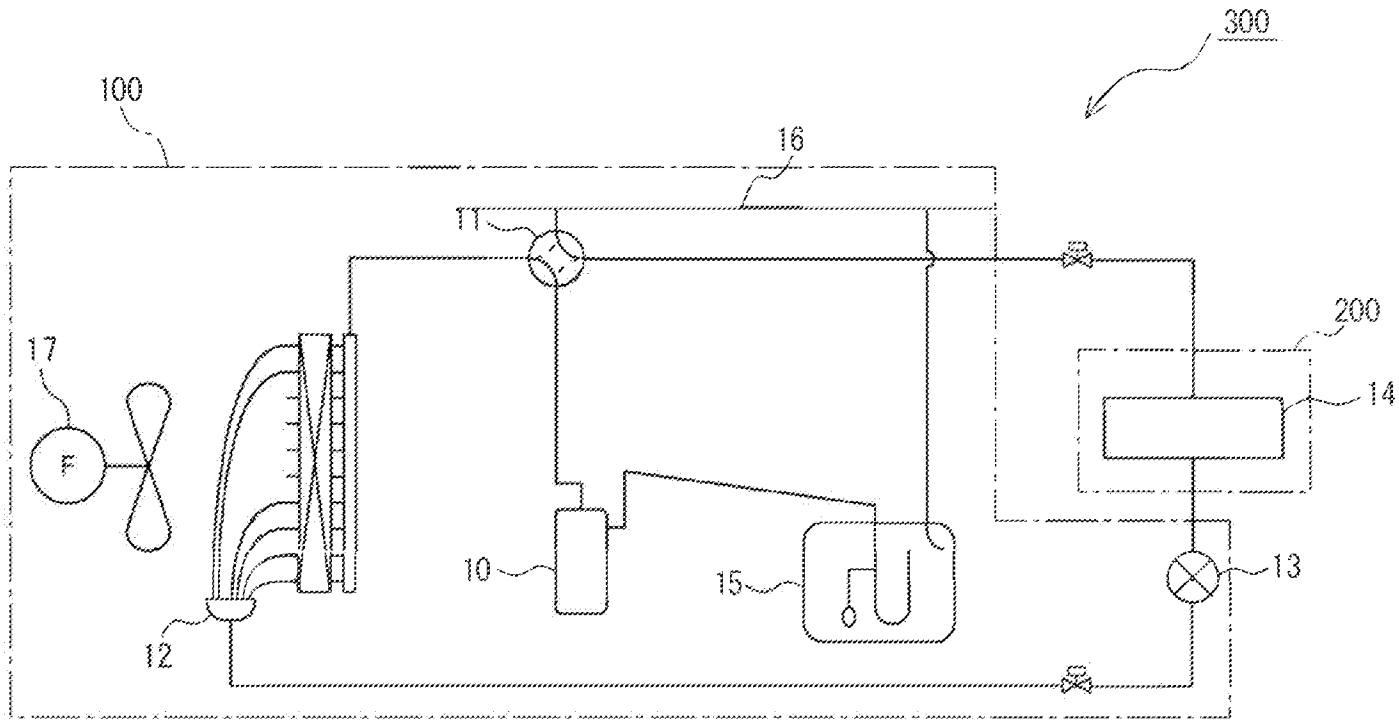
FIG. 1 illustrates a circuit configuration of an air-conditioning apparatus according to Embodiment 1 of the present invention.

Embodiments 1 and 2 of the present invention will now be described with reference to the drawings, Throughout the drawings, the same or corresponding parts are assigned the same reference numerals and their description will be omitted or simplified as appropriate. The shapes, sizes, and arrangements of components illustrated in the drawings may be appropriately changed within the scope of the present invention.

Embodiment 1

FIG. 1 illustrates a circuit configuration of an air-conditioning apparatus according to Embodiment 1 of the present invention. As illustrated in FIG. 1, an outdoor unit 100 of an air-conditioning apparatus 300 according to Embodiment 1 constitutes the air-conditioning apparatus 300 together with an indoor unit 200 that performs indoor air conditioning. The air-conditioning apparatus 300 has a refrigerant circuit where a compressor 10, a flow switching unit 11, an outdoor heat exchanger 12, an expansion mechanism 13, an indoor heat exchanger 14, and an accumulator 15 are connected by a refrigerant pipe 16 to allow refrigerant to circulate.

The compressor 10 compresses suctioned refrigerant and discharges the resulting high temperature and pressure refrigerant. For example, the compressor 10 is a positive displacement compressor driven by an inverter-controlled motor and configured to be capable of varying the operating capacity (frequency).

The flow switching unit 11 is, for example, a four-way valve having the function of switching the flow of refrigerant. During cooling operation, the flow switching unit 11 switches the refrigerant flow to allow connection of a refrigerant discharge side of the compressor 10 to a gas side of the outdoor heat exchanger 12, and also to allow connection of a refrigerant suction side of the compressor 10 to a gas side of the indoor heat exchanger 14. During heating operation, on the other hand, the flow switching unit 11 switches the refrigerant flow to allow connection of the refrigerant discharge side of the compressor 10 to the gas side of the indoor heat exchanger 14, and also to allow connection of the refrigerant suction side of the compressor 10 to the gas side of the outdoor heat exchanger 12. The flow switching unit 11 may be a combination of two- or three-way valves.

The outdoor heat exchanger 12 is, for example, a fin-and-tube heat exchanger that includes a heat exchanger tube and many fins. The outdoor heat exchanger 12 allows refrigerant discharged from the compressor 10 and supplied to the outdoor heat exchanger 12 to exchange heat with air blown by an outdoor air-sending device 17 and passed through the outdoor heat exchanger 12, so that the refrigerant is cooled. The outdoor heat exchanger 12 is configured to function as a condenser during cooling operation to liquefy the refrigerant, and to also function as an evaporator during heating operation to vaporize the refrigerant.

The expansion mechanism 13 reduces pressure of the refrigerant flowing in the refrigerant circuit to expand the refrigerant. For example, the expansion mechanism 13 is constituted by an electronic expansion valve whose opening degree is variably controlled.

The indoor heat exchanger 14 functions as an evaporator during cooling operation to allow the refrigerant flowing out of the expansion mechanism 13 to exchange heat with air. The indoor heat exchanger 14 also functions as a condenser during heating operation to allow the refrigerant discharged from the compressor 10 to exchange heat with air. The indoor heat exchanger 14 draws in indoor air through an indoor air-sending device. After allowing the air to exchange heat with the refrigerant, the indoor heat exchanger 14 supplies the resulting air into the room. The accumulator 15 is disposed on the suction side of the compressor 10 and configured to store excess refrigerant circulating in the refrigerant circuit.

Figure 2:
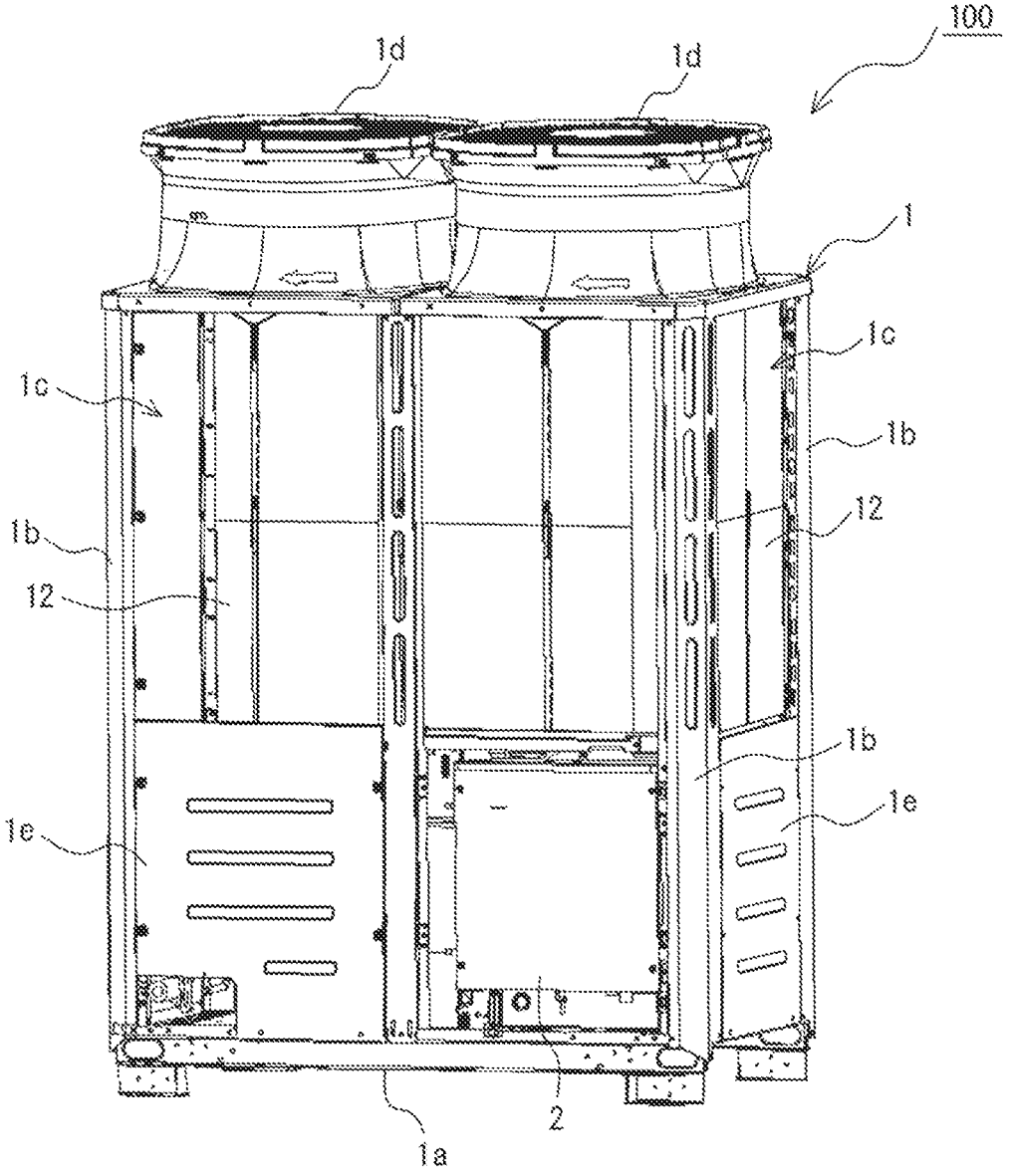
FIG. 2 is an external perspective view illustrating an outdoor unit of the air-conditioning apparatus according to Embodiment 1 of the present invention.
Figure 3:
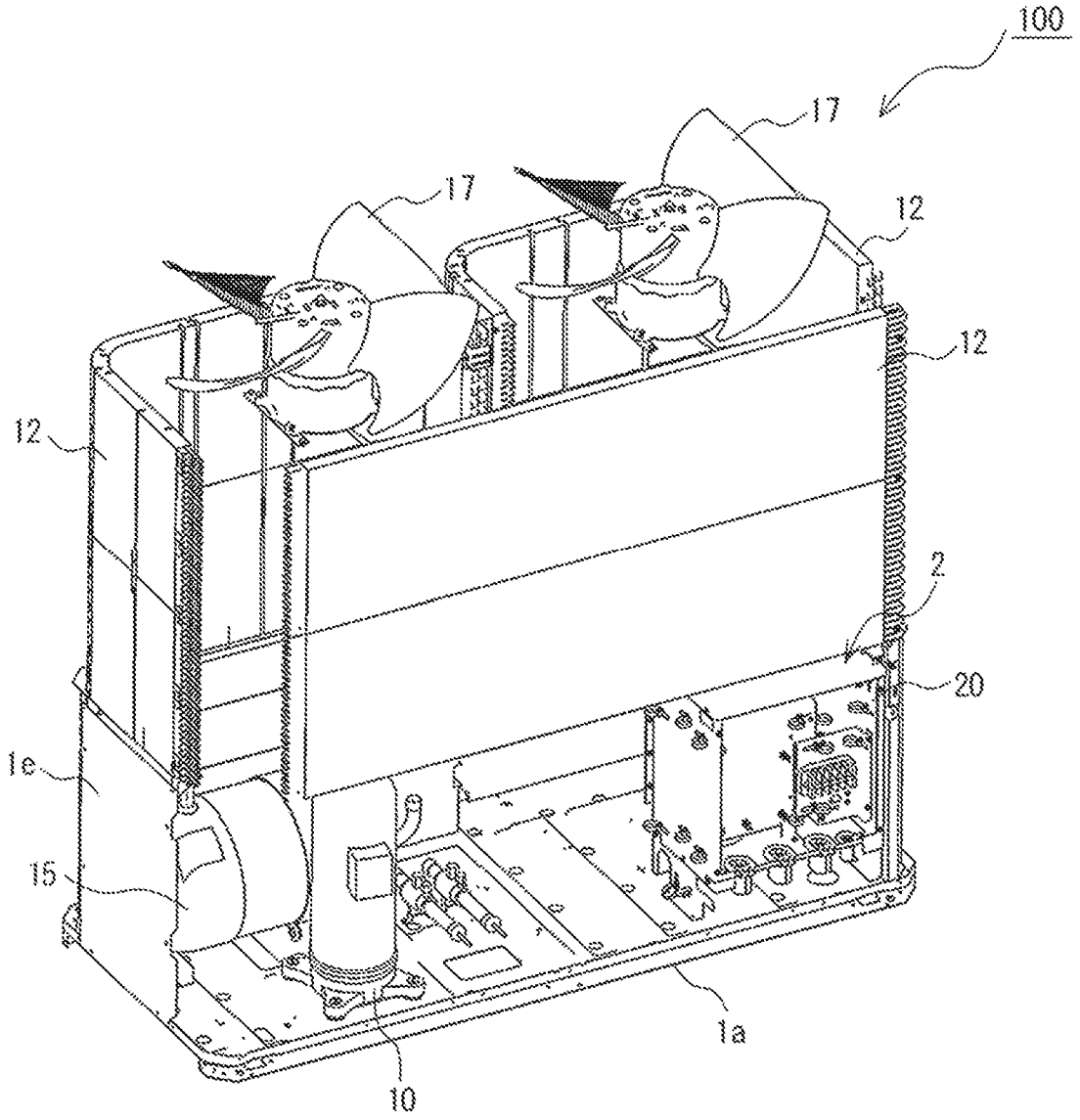
FIG. 3 illustrates an internal configuration of the outdoor unit of the air-conditioning apparatus according to Embodiment 1 of the present invention.
Figure 4:
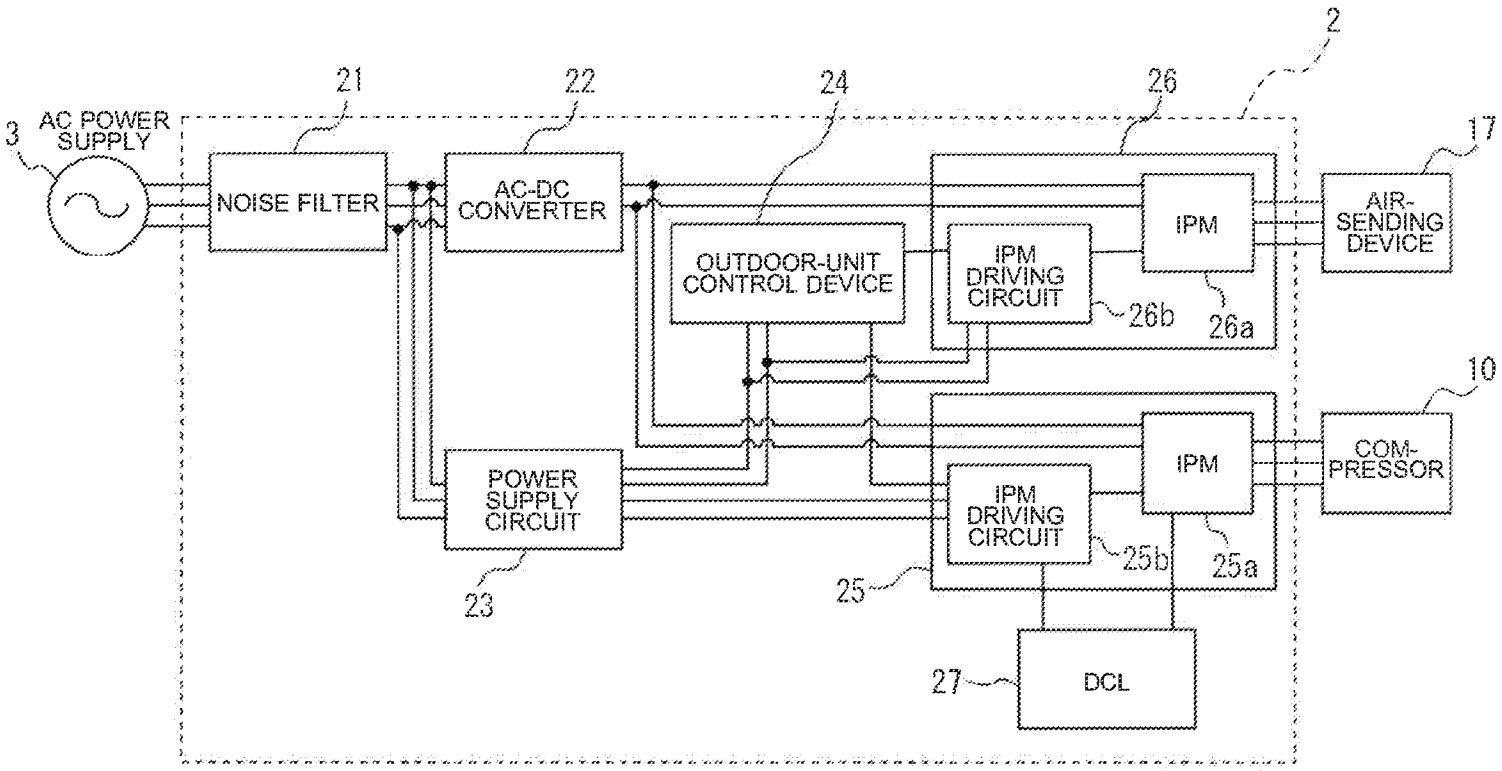
FIG. 4 is a block diagram illustrating a controller of the outdoor unit of the air-conditioning apparatus according to Embodiment 1 of the present invention.
Figure 5:
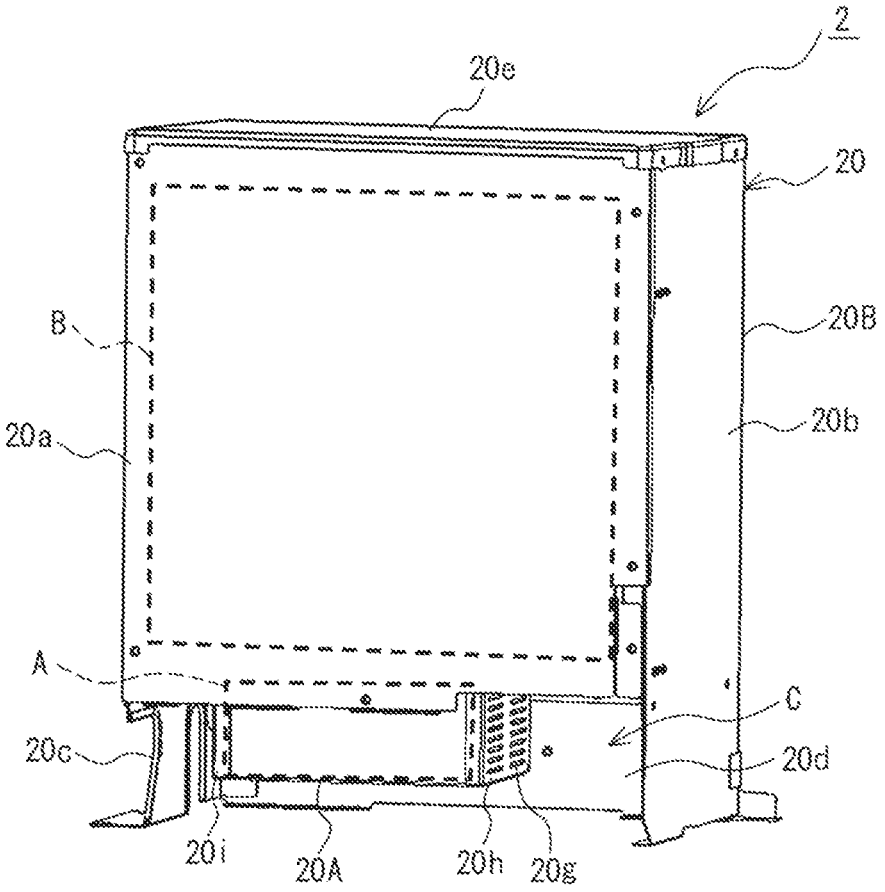
FIG. 5 is a perspective view illustrating the controller of the outdoor unit of the air-conditioning apparatus according to Embodiment 1 of the present invention.
Figure 6:
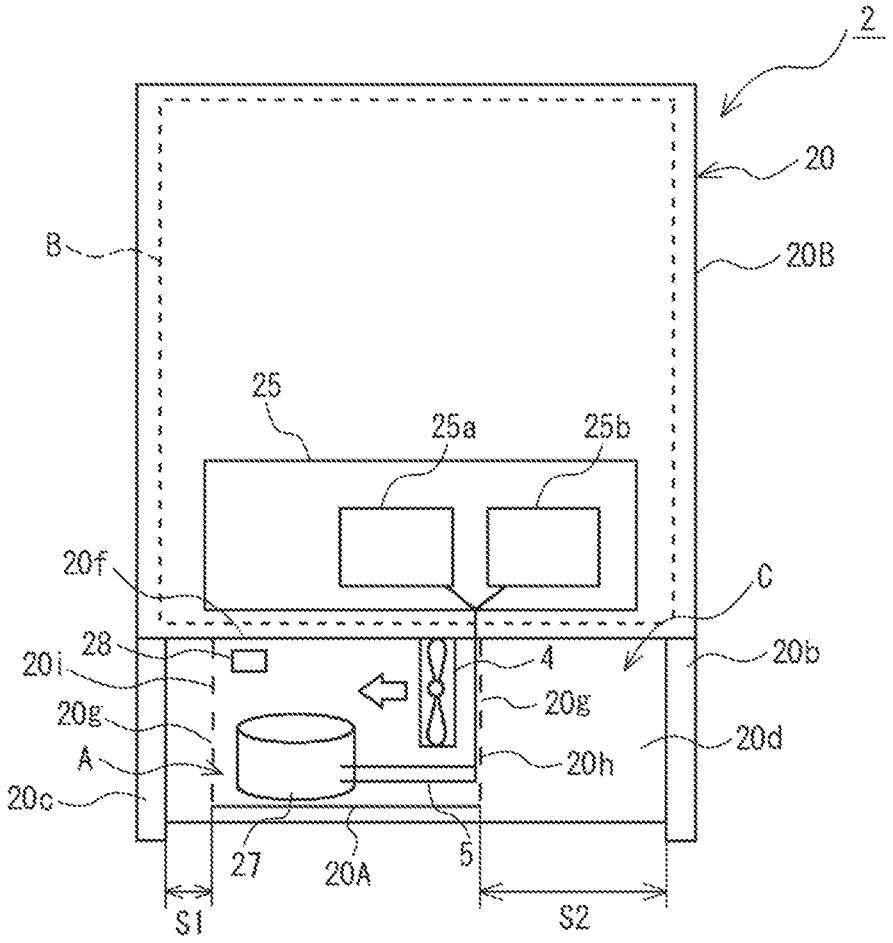
FIG. 6 is an internal configuration diagram schematically illustrating the controller of the outdoor unit of the air-conditioning apparatus according to Embodiment 1 of the present invention.
Figure 7:
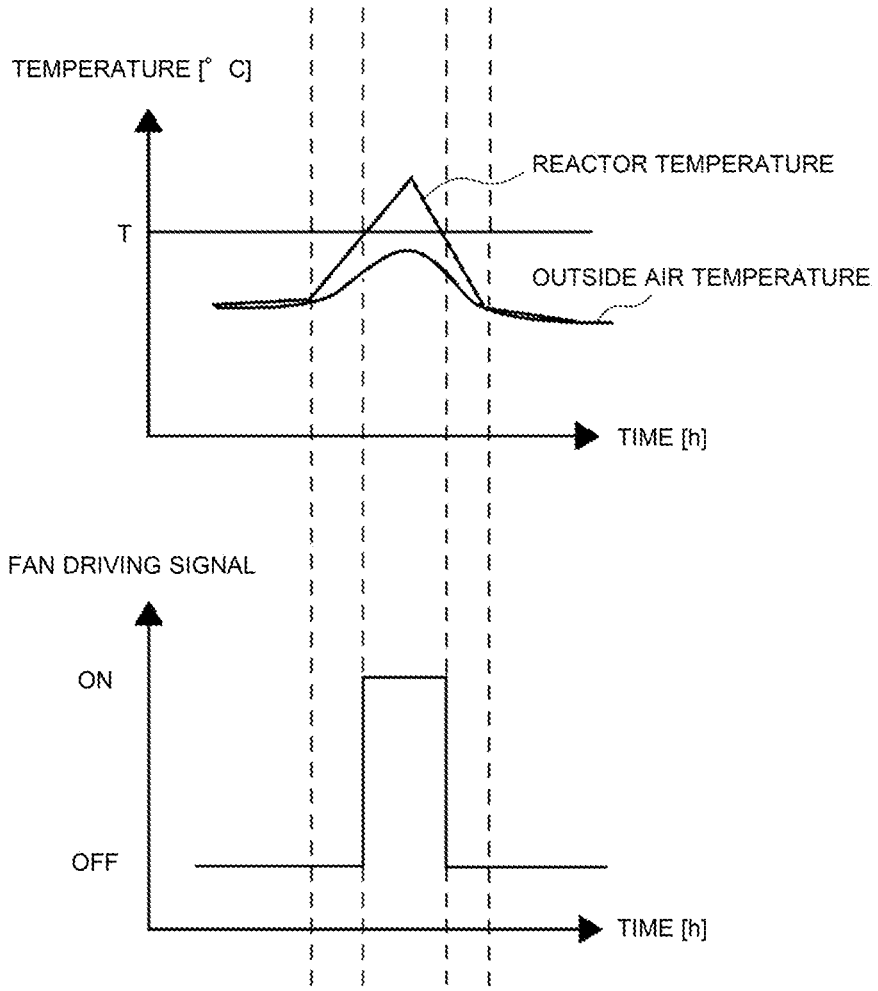
FIG. 7 is a diagram illustrating how a fan of the outdoor unit of the air-conditioning apparatus according to Embodiment 1 of the present invention is controlled.

With reference to FIG. 1, a structure of the outdoor unit 100 of the air-conditioning apparatus 300 will be described on the basis of FIG. 2 to FIG. 7. FIG. 2 is an external perspective view illustrating an outdoor unit of the air-conditioning apparatus according to Embodiment 1 of the present invention. FIG. 3 illustrates an internal configuration of the outdoor unit of the air-conditioning apparatus according to Embodiment 1 of the present invention. FIG. 4 is a block diagram illustrating a controller of the outdoor unit of the air-conditioning apparatus according to Embodiment 1 of the present invention. FIG. 5 is a perspective view illustrating the controller of the outdoor unit of the air-conditioning apparatus according to Embodiment 1 of the present invention. FIG. 6 is an internal configuration diagram schematically illustrating the controller of the outdoor unit of the air-conditioning apparatus according to Embodiment 1 of the present invention. FIG. 7 is a diagram illustrating how a fan of the outdoor unit of the air-conditioning apparatus according to Embodiment 1 of the present invention is controlled.

The outdoor unit 100 of the air-conditioning apparatus 300 has a configuration in which, as illustrated in FIG. 1 to FIG. 3, a rectangular chassis 1 forming a framework contains therein the compressor 10, the flow switching unit 11, the outdoor heat exchanger 12, the expansion mechanism 13, the outdoor air-sending device 17, and a controller 2.

As illustrated in FIG. 2, the chassis 1 has frame members 1*b* extending upward from the corners of a bottom plate 1*a* disposed at the bottom. The chassis 1 has, in its upper outer regions between adjacent ones of the frame members 1*b*, air inlets 1*c* for taking air into the chassis 1. The outdoor heat exchanger 12 is disposed along the air inlets 1*c*. The outdoor heat exchanger 12 is supported in the upper part of the interior of the chassis 1 by a support base disposed inside the chassis 1. The outdoor heat exchanger 12 is a so-called four-side heat exchanger that is structured to surround a space formed therein on four sides.

As illustrated in FIG. 2 and FIG. 3, the chassis 1 has air outlets 1*d* in the upper surface thereof, and the outdoor air-sending device 17 is disposed directly below the air outlets 1*d*. The outdoor air-sending device 17 includes, for example, propeller fans and is driven by an air-sending device motor. By driving the outdoor air-sending device 17, air drawn through the air inlets 1*c* into the chassis 1 is passed through the outdoor heat exchanger 12 to exchange heat with the refrigerant. The air is then passed through the outdoor air-sending device 17 and discharged from the air outlets 1*d*.

As illustrated in FIG. 2, the chassis 1 has, in its lower outer regions between adjacent ones of the frame members 1*b*, side panels 1*e* that are exterior metal plates. The lower outer regions of the chassis 1 are closed by the side panels 1*e*, Although FIG. 2 shows the controller 2 that is exposed, with one of the side panels 1*e* removed, the controller 2 is actually disposed inside the side panel 1*e* (currently not shown). The side panels 1*e* are secured to the frame members 1*b* at right and left side edges thereof with fastening members, such as screws, and are also secured to the bottom plate 1*a* at lower edges thereof with fastening members, such as screws. As illustrated in FIG. 3, the chassis 1 contains such components as the compressor 10, the accumulator 15, and the controller 2 in the lower inner part of the chassis 1 under the outdoor heat exchanger 12. That is, the outdoor heat exchanger 12 is disposed in a separate space from the other components. To access the components for maintenance or other purposes, the side panels 1*e* are removed to open up the interior of the outdoor unit 100.

The controller 2 receives input from an AC power supply 3 to drive and control the compressor 10 and the outdoor air-sending device 17. As illustrated in FIG. 2 and FIG. 3, the controller 2 has a configuration in which a control board with electric and electronic components mounted thereon is housed inside a housing 20. Specifically, as illustrated in FIG. 4, the controller 2 includes a noise filter 21, an AC-DC converter 22, a power supply circuit 23, an outdoor-unit control device 24, a compressor driving circuit 25, an air-sending-device driving circuit 26, and a harmonic suppressing unit 27.

The compressor driving circuit 25 includes a compressor inverter 25*a* that outputs, to the compressor 10, power with an output frequency and an output voltage corresponding to a command value from the outdoor-unit control device 24, and also includes an IPM driving circuit 25*b* that drives the compressor inverter 25*a*. The compressor inverter 25*a* is constituted, for example, by an intelligent power module (IPM) that is a semiconductor element. The compressor inverter 25*a* and the IPM driving circuit 25*b* are provided with the harmonic suppressing unit 27 therebetween. The harmonic suppressing unit 27 has the function of suppressing harmonics produced when the compressor 10 is driven during operation of the outdoor unit 100. The harmonic suppressing unit 27 is, for example, a direct-current reactor (DCL).

The air-sending-device driving circuit 26 includes an air-sending-device inverter 26*a* that outputs, to the air-sending device, power with an output frequency and an output voltage corresponding to a command value from the outdoor-unit control device 24, and also includes an IPM driving circuit 26*b* that drives the air-sending-device inverter 26*a*. The air-sending-device inverter 26*a* is constituted, for example, by an intelligent power module (IPM) that is a semiconductor element.

The housing 20 of the controller 2 is formed, for example, by metal plates. As illustrated in FIG. 5 and FIG. 6, the housing 20 has a first section A having ventilation holes 20*g* that allow communication between the outside and the inside, and a second section B constituting a frame outside the first section A. The first section A and the second section B are separated by a metal partitioning member 20*f*. The first section A is disposed below the second section B.

Specifically, the housing 20 includes a first sub-housing 20A forming the first section A and a second sub-housing 20B forming the second section B. The second sub-housing 20B is formed by a front plate 20*a*, right and left side plates 20*b* and 20*c* and a back plate 20*d* longer in the height direction than the front plate 20*a*, a top plate 20*e*, and the partitioning member 20*f* disposed at the lower end of the front plate 20*a* and configured to separate the first section A and the second section B. The second sub-housing 20B has the second section B that is a space surrounded by the front plate 20*a*, the right and left side plates 20*b* and 20*c*, the back plate 20*d*, the top plate 20*e*, and the partitioning member 20*f*, and a storage space C that is a space located under the second section B, surrounded by the right and left side plates 20*b* and 20*c*, the back plate 20*d*, and the partitioning member 20*f* and open at the front thereof. The first sub-housing 20A is disposed in the storage space C.

The second section B has no ventilation holes that allow communication between the outside and the inside, and is surrounded by metal plates. The second section B may have ventilation holes that allow communication between the outside and the inside. The housing 20 has a structure in which the internal space of the first section A and the internal space of the second section B are separated by using, for example, a bushing to prevent entry of rain and snow and are, at the same, thermally separated.

As illustrated in FIG. 6, the first sub-housing 20A is disposed closer to the side plate 20*c* of the right and left side plates 20*b* and 20*c*, with the ventilation holes 20*g* on the suction side facing the other side plate 20*b*. This creates a small gap S1 between a side wall 20*i* on the discharge side of the first section A and the side plate 20*c* of the second sub-housing 20B, and also creates a large gap S2 between a side wall 20*h* on the inlet side of the first section A and the other side plate 20*b*. The harmonic suppressing unit 27 is disposed on one side of the first section A adjacent to the small gap S1, and the fan 4 is disposed on the other side of the first section A adjacent to the large gap S2. Electric wires for supplying current to the electric and electronic components in the second section B are disposed adjacent to the large gap S2. The fan 4 blows air from inside the first section A to the outside through the ventilation holes 20*g* formed in the opposite side walls 20*h* and 20*i* of the second section B. The fan 4 is also driven and controlled by the controller 2.

The outdoor unit 100 of the air-conditioning apparatus according to Embodiment 1 is configured such that air flowing in through the opening at the front of the storage space C is turned toward, and fed into, the first section A through the ventilation holes 20*g* in the side wall 20*h*, so that dust and other foreign particles are less likely to be drawn into the first section A. This is because if air is linearly drawn into the first section A, dust and other foreign particles inside the chassis 1 are more likely to be carried by the air, and this may cause damage to the fan 4 and the harmonic suppressing unit 27. Since there are obstacles, such as electric wires, on the side of the large gap S2, it is less likely that water or dust and other foreign particles will be directly drawn into the first section A. Since air is drawn in from the large gap S2 between the side wall 20*h* of the first section A and the side plate 20*b* of the housing 20, air is easily drawn in and this improves cooling efficiency. Note that the second section B is almost entirely surrounded by metal plates. Therefore, even when the fan 4 is internally driven, it is less likely that dust and other foreign particles will be drawn in.

Note that the housing 20 does not necessarily need to be configured as illustrated in the drawings and may have other shapes. While not shown in the drawings, the first section A may be disposed above the second section B, or may be disposed to the right or left of the second section B. The first section A and the second section B may be formed by two housings that are detached and individually disposed at a distance.

The second section B contains the noise filter 21, the AC-DC converter 22, the power supply circuit 23, the outdoor-unit control device 24, the compressor driving circuit 25, the air-sending-device driving circuit 26, and other components. Note that the noise filter 21, AC-DC converter 22, the power supply circuit 23, the outdoor-unit control device 24, and the air-sending-device driving circuit 26 are not shown in FIG. 6.

The harmonic suppressing unit 27 produces up to about 100 W of heat during operation of the outdoor unit 100. To prevent overheating of the harmonic suppressing unit 27 from degrading the functions of other components, the outdoor unit 100 drives the fan 4 to blow air from inside the first section A to the outside through the ventilation holes 20*g*. The outdoor unit 100 is to be used in such a manner that the difference in temperature between the inside and outside of the first section A is less than about 50 degrees C. to 60 degrees C. In the outdoor unit 100, the electric and electronic components whose performance and product life are significantly affected by temperature rise are disposed in the second section B to be isolated from the harmonic suppressing unit 27.

As illustrated in FIG. 6, the first section A contains a temperature detecting unit 28 that detects a temperature inside the first section A. The temperature detecting unit 28 is constituted, for example, by a thermistor. As illustrated in FIG. 7, the controller 2 drives or stops the fan 4 on the basis of a determination as to whether the detection value of the temperature detecting unit 28 reaches a target value T. Specifically, if the controller 2 determines that the detection value of the temperature detecting unit 28 reaches the target value T, the controller 2 keeps driving the fan 4 to blow air from inside the first section A to the outside during the period in which the target value T is exceeded. Then, the controller 2 stops the fan 4 if it determines that the detection value of the temperature detecting unit 28 falls below the target value T. That is, the outdoor unit 100 of the air-conditioning apparatus 300 according to Embodiment 1 drives the fan 4 only when, for example, the daytime outside temperature is high and the temperature of the harmonic suppressing unit 27 rises accordingly. This extends the product life of the fan 4 and improves the energy saving effect.

As illustrated in FIG. 6, in the first section A, a conductive line 5 for supplying power to the harmonic suppressing unit 27 is disposed in contact with the side wall 20*h* having the ventilation holes 20*g*. In the outdoor unit 100, the operation of the fan 4 in wintertime may cause snow to be drawn into the first section A. If snow repeatedly hits the housing 20, the temperature of the side wall 20*h* having the ventilation holes 20*g* gradually decreases and the ventilation holes 20*g* may be obstructed with ice. With the ventilation holes 20*g* obstructed, air cannot be fully released from the first section A and this may lead to overheating. As described above, since the conductive line 5 is disposed in contact with the side wall 20*h* having the ventilation holes 20*g*, heat conducted from the harmonic suppressing unit 27 enables, for example, a temperature rise of about 7 to 8 (W). With this amount of heat, a decrease in the temperature of the side wall 20*h* having the ventilation holes 20*g* is reduced and the ventilation holes 20*g* are prevented from being obstructed with ice. An excessive temperature rise in the first section A caused by obstruction of the ventilation holes 20*g* is reduced and this also reduces a temperature rise inside the second section B.

By controlling the fan 4 on the basis of the detection value of the temperature detecting unit 28, the controller 2 may change (e.g., reverse) the direction of flow of air circulating between the outside and inside of the housing 20. If the ventilation holes 20*g* are obstructed, for example, with dust or ice, air inside the first section A may not be fully released to the outside by the fan 4 and may be heated to a high temperature. In the outdoor unit 100, therefore, the fan 4 is controlled to change the flow of air. The ventilation holes 20*g* obstructed with dust or ice are thus returned to the original state and a temperature rise in the first section A is reduced.

Figure 8:
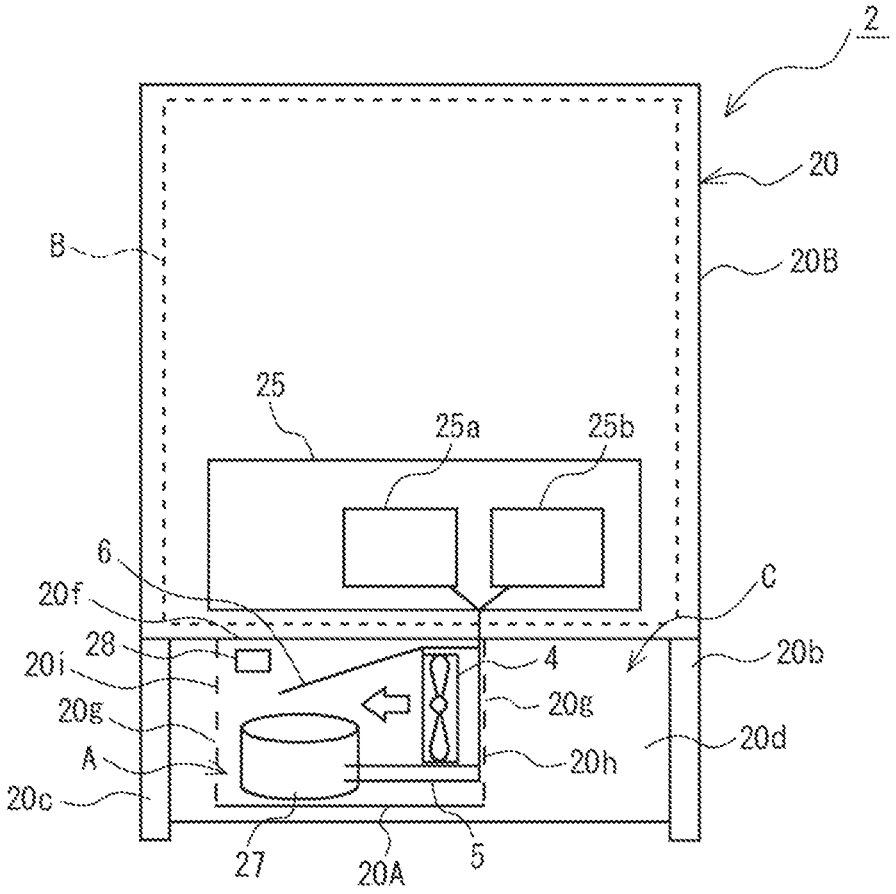
FIG. 8 is an internal configuration diagram schematically illustrating a modification of the outdoor unit of the air-conditioning apparatus according to Embodiment 1 of the present invention.

FIG. 8 is an internal configuration diagram schematically illustrating a modification of the outdoor unit of the air-conditioning apparatus according to Embodiment 1 of the present invention. As illustrated in FIG. 8, the first section A contains an air-passage forming member 6 that makes the air passage gradually narrower with increasing distance from the ventilation holes 20*g* on the inlet side toward the harmonic suppressing unit 27. The air-passage forming member 6 is formed, for example, by an air guiding plate made of metal, and is obliquely disposed above the harmonic suppressing unit 27. By making the air passage gradually narrower with increasing distance from the ventilation holes 20*g* on one side toward the harmonic suppressing unit 27, the flow rate of air around the harmonic suppressing unit 27 is increased, and the harmonic suppressing unit 27 being heated is more effectively cooled. Heat from the harmonic suppressing unit 27 is radiated to the air-passage forming member 6, through which the heat is conducted to the side wall 20*h* of the housing 20. With this amount of heat, a decrease in the temperature of the side wall 20*h* having the ventilation holes 20*g* is reduced and the ventilation holes 20*g* are prevented from being obstructed with ice.

The outdoor unit 100 of the air-conditioning apparatus 300 according to Embodiment 1 includes the compressor 10, the outdoor heat exchanger 12, the outdoor air-sending device 17, and the controller 2. The controller 2 includes the compressor driving circuit 25 that drives the compressor 10, the harmonic suppressing unit 27 that suppresses harmonics in the compressor driving circuit 25, and the housing 20 that contains the compressor driving circuit 25 and the harmonic suppressing unit 27. The housing 20 has the first section A having the ventilation holes 20*g* that allow communication between the outside and the inside, and the second section B constituting a frame outside the first section A. The first section A contains the harmonic suppressing unit 27 and the fan 4 that blows air from inside the first section A to the outside. The second section B contains electric and electronic components whose performance and product life are significantly affected by temperature rise. In the outdoor unit 100 of the air-conditioning apparatus 300, the housing 20 containing electric and electronic components has the first section A and the second section B, and the electric and electronic components, such as the compressor driving circuit 25, whose performance and product life are significantly affected by temperature rise are disposed in the second section B. Since this enables isolation from the harmonic suppressing unit 27 disposed in the first section A, it is less likely that the performance and product life of the electric and electronic components constituting the controller 2 will be affected.

The first section A contains the temperature detecting unit 28 that detects a temperature inside the first section A. The controller 2 drives or stops the fan 4 on the basis of a determination as to whether the detection value of the temperature detecting unit 28 reaches the target value T. The outdoor unit 100 of the air-conditioning apparatus 300 according to Embodiment 1 drives the fan 4 only when, for example, the daytime outside temperature is high and the temperature of the harmonic suppressing unit 27 rises accordingly. This extends the product life of the fan 4 and improves the energy saving effect.

By controlling the fan 4 on the basis of the detection value of the temperature detecting unit 28, the controller 2 changes (e.g., reverses) the direction of flow of aft circulating between the outside and inside of the housing 20. In the outdoor unit 100 of the air-conditioning apparatus 300 according to Embodiment 1, therefore, if the ventilation holes 20*g* on the inlet side are obstructed, for example, with dust or ice, the direction of air flow is changed by controlling the fan 4. The ventilation holes 20*g* are thus returned to the original state and a temperature rise in the first section A is reduced.

In the housing 20, the first section A having the ventilation holes 20*g* is formed by metal plates. In the first section A, the conductive line 5 for supplying power to the harmonic suppressing unit 27 is disposed in contact with the side wall 20*h* having the ventilation holes 20*g*. In the outdoor unit 100 of the air-conditioning apparatus 300, therefore, heat conducted from the harmonic suppressing unit 27 reduces a decrease in the temperature of the side wall 20*h* having the ventilation holes 20*g* in wintertime, and prevents the ventilation holes 20*g* from being obstructed with ice. An excessive temperature rise in the first section A is reduced and this also effectively reduces a temperature rise inside the second section B.

The first section A contains the air-passage forming member 6 that makes the air passage gradually narrower with increasing distance from the ventilation holes 20*g* toward the harmonic suppressing unit 27. The outdoor unit 100 of the air-conditioning apparatus 300 thus increases the flow rate of air around the harmonic suppressing unit 27, and more effectively cools the harmonic suppressing unit 27 being heated.

The housing 20 includes the first sub-housing 20A forming the first section A, and the second sub-housing 20B forming the second section B. The second sub-housing 20B has the front plate 20*a*, the right and left side plates 20*b* and 20*c* and the back plate 20*d* longer in the height direction than the front plate 20*a*, the top plate 20*e*, and the partitioning member 20*f* disposed at the lower end of the front plate 20*a* and configured to separate the first section A and the second section B. The space surrounded by the front plate 20*a*, the right and left side plates 20*b* and 20*c*, the back plate 20*d*, the top plate 20*e*, and the partitioning member 20*f* is the second section B, whereas the space located under the second section B, surrounded by the right and left side plates 20*b* and 20*c*, the back plate 20*d*, and the partitioning member 20*f*, and open at the front thereof is the storage space C. The first sub-housing 20A is disposed in the storage space C. With this simple structure, the outdoor unit 100 of the air-conditioning apparatus 300 effectively isolates, from the harmonic suppressing unit 27, the electric and electronic components whose performance and product life are significantly affected by temperature rise.

The first sub-housing 20A is disposed closer to the side plate 20*c* of the right and left side plates 20*b* and 20*c*, with the ventilation holes 20*g* on the suction side facing the other side plate 20*b*. The outdoor unit 100 of the air-conditioning apparatus 300 is configured such that air flowing in through the opening at the front of the storage space C is turned toward, and fed into, the first section A through the ventilation holes 20*g* in the side wall 20*h*. This makes it less likely that dust and other foreign particles will be drawn into the first section A.

Embodiment 2

Figure 9:
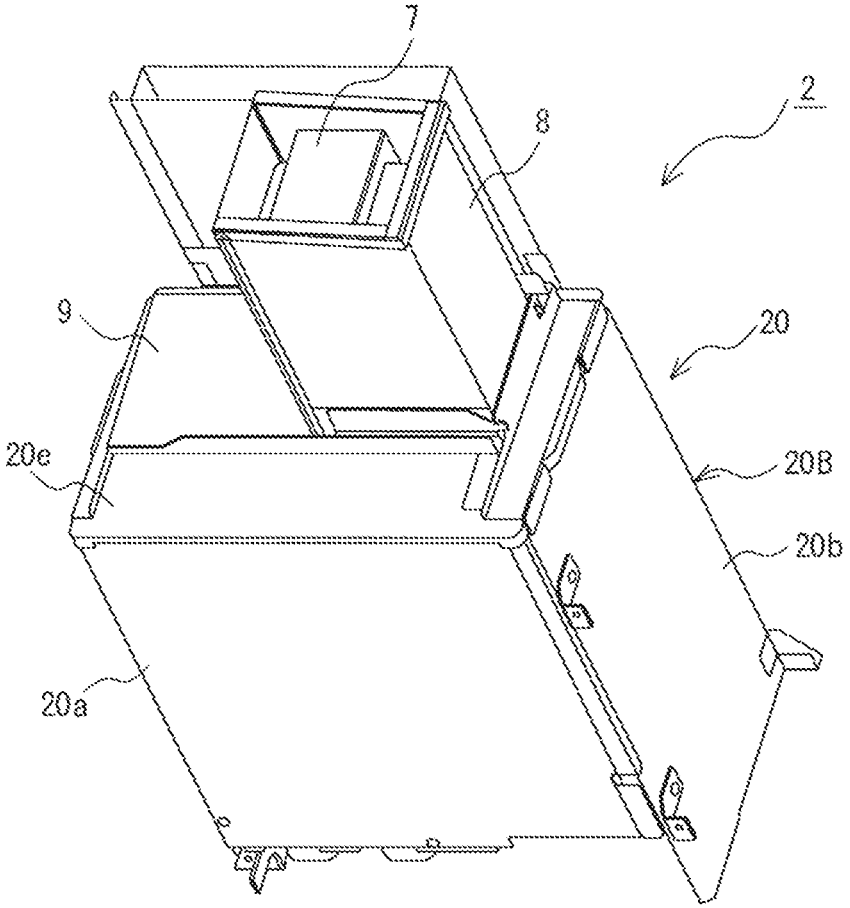
FIG. 9 is a perspective view illustrating a controller of an outdoor unit of an air-conditioning apparatus according to Embodiment 2 of the present invention.
Figure 10:
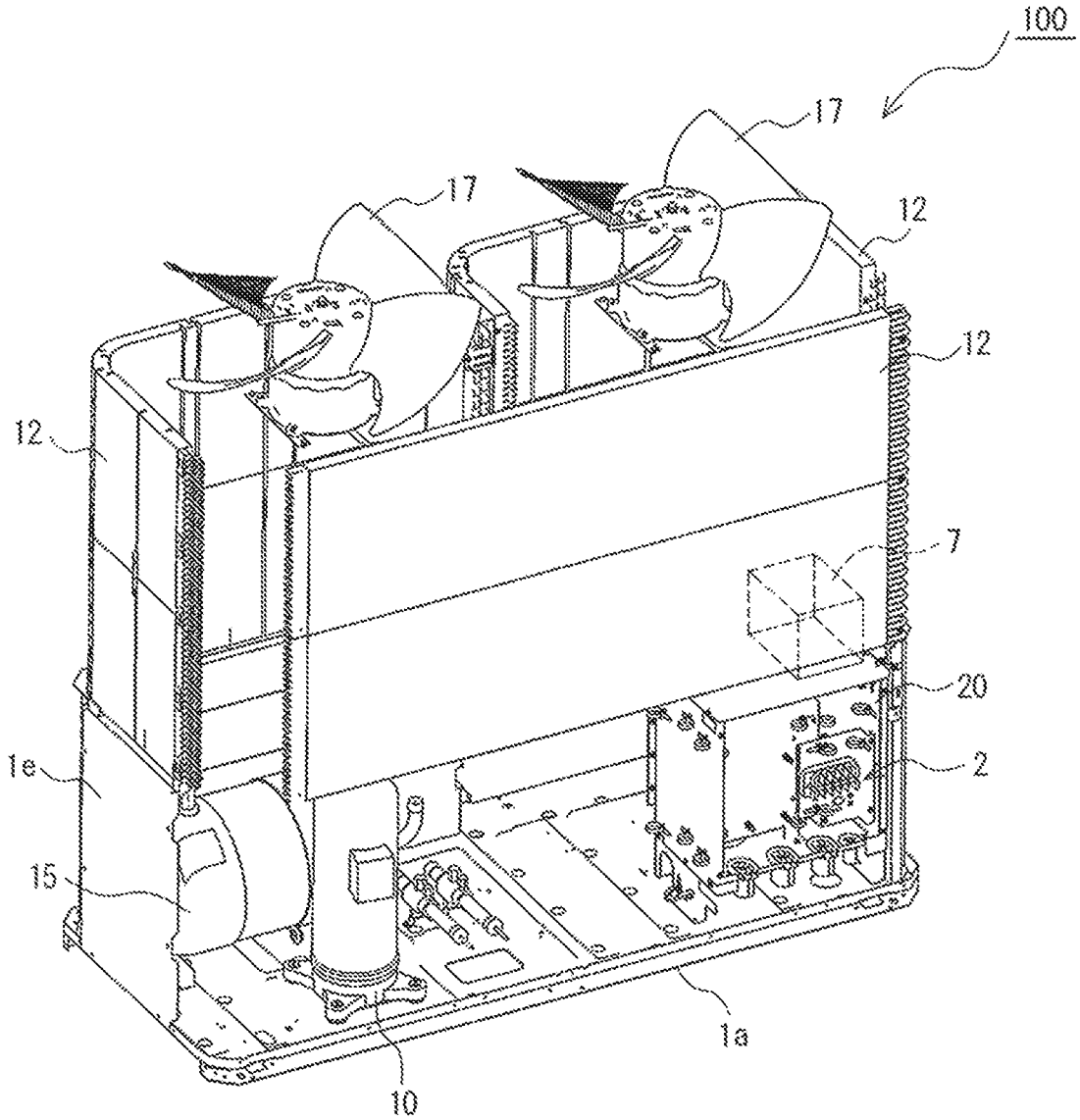
FIG. 10 illustrates an internal configuration of the outdoor unit of the air-conditioning apparatus according to Embodiment 2 of the present invention.

The outdoor unit 100 of the air-conditioning apparatus 300 according to Embodiment 2 of the present invention will now be described on the basis of FIG. 9 and FIG. 10. FIG. 9 is a perspective view illustrating a controller of an outdoor unit of an air-conditioning apparatus according to Embodiment 2 of the present invention. FIG. 10 illustrates an internal configuration of the outdoor unit of the air-conditioning apparatus according to Embodiment 2 of the present invention. Note that components that are the same as those of the outdoor unit 100 of the air-conditioning apparatus 300 described in Embodiment 1 are assigned the same reference numerals and their description will be omitted as appropriate.

The controller 2 of Embodiment 2 is characterized in that a transformer 7 is mounted on an upper surface of the housing 20. The configuration of this outdoor unit 100 of the air-conditioning apparatus 300 is effective when the transformer 7 cannot be installed inside the housing 20 due to, for example, power supply conditions at the location of installation.

In the block diagram of FIG. 4, the transformer 7 is disposed in a branch line that branches off between the AC power supply 3 and the noise filter 21 and is connected to the power supply circuit. In the branch line, for example, a control board for controlling, for example, the expansion mechanism 13 of 200 V in the outdoor unit 100 is connected in series to the transformer 7. The transformer 7 is a voltage varying unit that varies the output power of the control board.

For example, two transformers 7 are vertically stacked and housed inside a waterproofed casing 8. The casing 8 is secured to a securing member 9 on the upper surface of the housing 20. The securing member 9 is formed, for example, by a steel plate and joined to the casing 8 with joining members, such as bolts. The outdoor unit 100 thus reliably stabilizes the transformer 7 installed therein and protects the transformer 7 from exposure to rain and snow. The securing member 9 is not limited to that illustrated herein, and may have any configuration that enables the casing 8 to be secured to the housing 20.

As illustrated in FIG. 10, at least part of the transformer 7 is disposed in the space surrounded by the outdoor heat exchanger 12. When the transformer 7 is thus disposed in the place where air flows, the transformer 7 being heated is effectively cooled.

Although the present invention has been described on the basis of Embodiments 1 and 2, the present invention is not limited to the configurations of Embodiments 1 and 2. For example, the outdoor unit 100 is not limited to that described above and may include other constituent elements. That is, the present invention includes a range of design changes and variations of application typically carried out by those skilled in the art, without departing from the scope of the technical ideas thereof.

REFERENCE SIGNS LIST

1 chassis, 1*a* bottom plate, 1*b* frame member, 1*c* air inlet, 1*d* air outlet, 1*e* side panel, 2 controller, 3 AC power supply, 4 fan, 5 conductive line, 6 air-passage forming member, 7 transformer, 8 casing, 9 securing member, 10 compressor, 11 flow switching unit, 12 outdoor heat exchanger, 13 expansion mechanism, 14 indoor heat exchanger, 15 accumulator, 16 refrigerant pipe, 17 outdoor air-sending device, 20 housing, 20A first sub-housing, 20B second sub-housing, 20*a* front plate, 20*b*, 20*c* side plate, 20*d* back plate, 20*e* top plate, 20*f* partitioning member, 20*g* ventilation hole, 20*h*, 20*i* side wall, 21 noise filter, 22 AC-DC converter, 23 power supply circuit, 24 outdoor-unit control device, 25 compressor driving circuit, 25*a* compressor inverter, 25*b* IPM driving circuit, 26 air-sending-device driving circuit, 26*a* air-sending-device inverter, 26*b* IPM driving circuit, 27 harmonic suppressing unit, 28 temperature detecting unit, 100 outdoor unit, 200 indoor unit, 300 air-conditioning apparatus, A first section, B second section

The invention claimed is:

1. An outdoor unit of an air-conditioning apparatus, the outdoor unit comprising a compressor, a heat exchanger, and a controller, wherein the controller includes a compressor driving circuit configured to drive the compressor, a harmonic suppressing unit, comprising a direct current reactor, configured to suppress harmonics in the compressor driving circuit, and a housing containing the compressor driving circuit and the harmonic suppressing unit;

the housing has a first section having ventilation holes configured to allow communication between an outside of the housing and an inside of the first section, and a second section constituting a frame separate from the first section;

the first section contains the harmonic suppressing unit and a fan configured to blow air from the inside of the first section to the outside of the housing through the ventilation holes; and the second section contains the compressor driving circuit.

2. The outdoor unit of an air-conditioning apparatus of claim 1, wherein the first section contains a temperature detecting unit, comprising a thermistor, configured to detect a temperature inside the first section; and the controller drives or stops the fan based on a determination as to whether a detection value of the temperature detecting unit reaches a target value.

3. The outdoor unit of an air-conditioning apparatus of claim 2, wherein the controller controls the fan based on the detection value of the temperature detecting unit, and changes a direction of flow of air circulating between the outside of the housing and the inside of the first section.

4. The outdoor unit of an air-conditioning apparatus of claim 1, wherein the first section having the ventilation holes is formed by metal plates; and a conductive line for supplying power to the harmonic suppressing unit is disposed within the first section and is in contact with a side wall of the first section having the ventilation holes.

5. The outdoor unit of an air-conditioning apparatus of claim 1, wherein the first section contains an air-passage forming member, comprising a metal air guiding plate, configured to make an air passage gradually narrower with increasing distance from the ventilation holes toward the harmonic suppressing unit.

6. The outdoor unit of an air-conditioning apparatus of claim 1, wherein the housing includes a first sub-housing forming the first section and a second sub-housing forming the second section;

the second sub-housing has a front plate, right and left side plates and a back plate longer in a height direction than the front plate, a top plate, and a partitioning member disposed at a lower end of the front plate and configured to separate the first section and the second section;

a space surrounded by the front plate, the right and left side plates, the back plate, the top plate, and the partitioning member is the second section;

a space located under the second section, surrounded by the right and left side plates, the back plate, and the partitioning member, and open at a front thereof is a storage space; and the first sub-housing is disposed in the storage space.

7. The outdoor unit of an air-conditioning apparatus of claim 6, wherein the first sub-housing is disposed closer to one of the right side plate and the left side plate, and the ventilation holes are on a suction side of the first section and face an other of the right side plate and the left side plate.

8. The outdoor unit of an air-conditioning apparatus of claim 1, wherein a transformer is mounted on an upper surface of the housing.

9. The outdoor unit of an air-conditioning apparatus of claim 8, wherein the transformer is housed inside a waterproofed casing; and the casing is secured in place by a securing member disposed on the upper surface of the housing.

10. The outdoor unit of an air-conditioning apparatus of claim 8, wherein the transformer is disposed in a space surrounded by the heat exchanger.

* * * * *